US005894614A

United States Patent [19]

Stroud

[11] Patent Number: 5,894,614

[45] Date of Patent: Apr. 20, 1999

[54] BED RAIL CENTER SUPPORT SYSTEM

[75] Inventor: David W. Stroud, Linwood, N.C.

[73] Assignee: L&P Property Management Company, South Gate, Calif.

[21] Appl. No.: 08/990,671

[22] Filed: Dec. 15, 1997

[51] Int. Cl.[6] ..... A47C 19/02

[52] U.S. Cl. ..... 5/200.1; 5/201; 5/202; 5/312

[58] Field of Search ..... 5/200.1, 201, 202, 5/310, 312

[56] References Cited

U.S. PATENT DOCUMENTS

| | | | |
|---|---|---|---|
| Re. 27,182 | 9/1971 | Fredman . | |
| 1,459,972 | 6/1923 | Clauson et al. . | |
| 1,607,420 | 11/1926 | Williams . | |
| 1,625,476 | 4/1927 | Larsen . | |
| 2,900,647 | 8/1959 | Sands . | |
| 2,911,674 | 11/1959 | Roche et al. | 5/310 |
| 2,930,052 | 3/1960 | Andreasen . | |
| 2,935,813 | 5/1960 | Berman et al. . | |
| 3,031,689 | 5/1962 | Sark . | |
| 3,114,917 | 12/1963 | Bogar, Jr. . | |
| 3,118,151 | 1/1964 | Fredman . | |
| 3,327,328 | 6/1967 | Slivoski . | |
| 3,644,948 | 2/1972 | Fredman . | |
| 3,761,970 | 10/1973 | Fredman . | |
| 3,761,971 | 10/1973 | Behnke | 5/201 |
| 3,848,280 | 11/1974 | Allen et al. . | |
| 4,038,710 | 8/1977 | Tambascio . | |
| 4,078,271 | 3/1978 | Tambascio . | |
| 4,080,674 | 3/1978 | Fredman et al. | 5/310 |
| 4,103,374 | 8/1978 | Knoke . | |
| 4,146,940 | 4/1979 | Fredman et al. . | |
| 4,193,146 | 3/1980 | Fredman et al. . | |
| 4,263,683 | 4/1981 | Knoke . | |
| 4,354,287 | 10/1982 | Fredman . | |
| 4,598,434 | 7/1986 | Mis . | |
| 4,627,120 | 12/1986 | Harris . | |
| 4,670,922 | 6/1987 | Mis . | |
| 5,203,039 | 4/1993 | Fredman . | |
| 5,231,713 | 8/1993 | McDonnell . | |
| 5,477,571 | 12/1995 | Roggenkamp et al. . | |
| 5,502,852 | 4/1996 | Fredman et al. . | |

*Primary Examiner*—Michael F. Trettel

[57] ABSTRACT

A bed frame center support assembly comprising a pair of parallel cross support members extending between two opposed side rails of a bed frame, a center support member extending between the cross support members and at least one leg assembly pivotally secured to one of the support members. The leg assembly may comprise a first leg pivotally secured to a vertical web of one of the support members, a plastic insert and a foot member. Alternatively, the leg assembly may comprise a first leg nestably secured to a second leg in order to increase the length of the leg assembly. A threaded foot is adapted to engage a bracket integrally formed in the bottom of either the first leg or the second leg further increasing the vertical adjustability of the length of the leg assembly.

20 Claims, 3 Drawing Sheets

FIG. I

BED RAIL CENTER SUPPORT SYSTEM

FIELD OF THE INVENTION

This invention relates to bed frames having two opposed side rails connecting a headboard and a footboard and, more particularly, to a rigid metallic center support system with multiple legs adapted to be secured to the side rails of such a bed frame.

BACKGROUND OF THE INVENTION

A conventional bed frame has two opposed side rails extending between a footboard and a headboard. These side rails may be made of any material but are most often made of wood. The side rails often have a flat horizontal flange extending inwardly from a vertical portion. In order to support the weight of a box spring and mattress, a plurality of transversely extending wooden or metal slats often were inserted between the side rails and rested on the horizontal flanges of the side rails. However, such transversely extending slats often warped, twisted outwardly or deflected under the weight of the box spring and mattress placed on top of the rails. As wider span-size beds such as a queen size bed which is 60" standard width or a king size bed which is 76" standard width became more popular, the wooden slats had to become longer and wider. The problem of twisting or torquing slats increased and in addition, the two opposed side rails tended to twist or turn outwardly as well due to the weight placed on the slats.

U.S. Pat. No. 4,080,674 discloses a center cross bar extending transversely of two opposed side bed rails which eliminates the need for transversely extending slats. The center cross bar is provided with two vertically adjustable supporting leg assemblies, each leg assembly having a vertically adjustable glide or foot at the lower end thereof. The glides contact a floor or other supporting surface to support the cross bar so as to prevent sagging of a box spring placed thereon and prevent any vertical deflection, horizontal deflection and twisting or torquing of the opposed side rails of the bed frame. Such a vertically adjustable supporting leg assembly incorporated into a cross bar enabled the two opposed bed rails or side rails to be pulled into a snug engagement with a box spring over a substantial portion of the length of the box spring in order to provide a firm support for the box spring along the bottom side and center portion of the box spring without having to utilize transversely extending removable slats.

U.S. Pat. No. 5,203,039 discloses a cross bar adjustable in length as well as height adapted to extend between two wooden side rails of a bed frame. The cross bar has multiple legs which are pivotally connected to the cross bar and capable of pivoting upwardly into a nesting relation with the cross bar for ease of packaging and/or shipping. The legs are also capable of being pivoted downwardly and secured in an erect position. In addition, this patent discloses a cross bar which is adjustable in length because the cross bar comprises two nestable sections each comprising an "L" shaped angle iron. The sections may be pulled apart to increase the length of the cross bar to fit a king size bed and an overlapped, nested portion of the sections secured with a clamp and thumb screw.

U.S. Pat. No. 5,502,852 discloses an extensible leg for a bed cross bar similar to the legs disclosed in U.S. Pat. No. 5,203,039. Like the legs disclosed in U.S. Pat. No. 5,203,039, the legs disclosed in U.S. Pat. No. 5,502,852 are adjustable in height and may be folded upwardly into a nested position inside the cross bar which has an L-shaped cross-sectional configuration. The leg disclosed in U.S. Pat. No. 5,502,852 has an integral bracket formed on the free end of the leg which is formed from the material of the leg and defines a substantially square opening which retains a plastic bushing and a threaded foot which can be raised and lowered in order to adjust the height of the cross bar relative to the supporting surface or floor. Thus, the leg disclosed in this patent is easier to fabricate and less expensive to make than the leg disclosed in U.S. Pat. No. 5,203,039.

However, in both the legs disclosed in U.S. Pat. Nos. 5,203,039 and 5,502,852, the height which the leg can be adjusted is limited by the height of the threaded stem of the foot member. The threads of the stem of the foot member are adapted to engage a plastic insert received within either the square opening of the integral bracket formed on the free end of the leg (U.S. Pat. No. 5,502,852) or a separate bracket secured to the leg with rivets (U.S. Pat. No. 5,203,039). Therefore, the vertical adjustment of the cross bar is limited to approximately the height of the threaded stem of the foot member which is typically only a few inches. Therefore, the height of the side rails above the supporting surface is limited because the bottom of the threaded foot members must engage the supporting surface in order to properly support a box spring placed on the bed frame.

Therefore, it has been one objective of the present invention to provide an adjustable bed frame center support assembly having legs which may be adjusted in height more than heretofore known legs having adjustable heights.

It has been a further objective of the present invention to provide a bed frame center support assembly comprising two cross support members and one center support member each having one or more vertically adjustable legs.

It has been a further objective of the present invention to provide a leg assembly which may be pivotally secured to a support member having an "L" shaped cross sectional configuration and nested therein, the leg assembly comprising multiple pieces which may be removably secured to one another.

SUMMARY OF THE INVENTION

The invention of the application which accomplishes these objectives comprises a pair of spaced parallel cross support members extending between two opposed side rails of a bed frame, a center support member and at least one leg assembly. The center support member extends between the cross support members and is generally parallel the side rails of the bed frame and perpendicular to the cross support members of the center support assembly.

At least one leg assembly is pivotally secured to one of the support members. The leg assembly comprises a first leg pivotally secured to a vertical web of the support member. The first leg has a hole therethrough adapted to receive a fastener for securing the first leg in a down locked position. The first leg has two coplanar flanges separated by a longitudinally extending groove and a bracket integrally formed in the end of the first leg remote from its pivotal connection to the vertical web. The bracket has a circular opening therethrough of a fixed diameter.

A plastic insert is adapted to fit inside the circular opening of the bracket. The plastic insert has a cylindrical body portion and a flange at one end of the body portion. The flange has a diameter greater than the fixed diameter of the circular opening. The plastic insert has a threaded thorough-bore extending through the body portion and the flange.

The leg assembly further includes a foot member having a threaded stem. The threaded stem is adapted to engage the threaded thoroughbore of the plastic insert when the plastic insert is placed inside the circular opening of the bracket. The foot member enables the leg assembly to have an adjustable height so that the distance from the foot member to the side rails of the bed frame can be adjusted by threading the threaded stem through the threaded thoroughbore of the plastic insert. A wing nut is located underneath the plastic insert. The wing nut may be tightened in order to fix the height of the leg assembly.

If a longer leg assembly is desired, a second leg may be secured to the first leg of each leg assembly. The second leg may have a longitudinal dimension greater than the longitudinal dimension of the first leg. However, the second leg is identically configured to the first leg, the second leg having two coplanar flanges and a longitudinally extending groove located between the flanges. The second leg also has a bracket integrally formed in the end of the second leg remote from its connection to the first leg. The bracket has a circular opening therethrough like the bracket of the first leg. The second leg and the first leg may be nestably connected with a fastener such that the bracket of the first leg resides in the groove of the second leg, the second leg being underneath the first leg. The legs are connected by a fastener passing through holes formed in the nested grooves of the legs.

Like the first leg, the bracket formed in the second leg is adapted to receive a plastic insert. The plastic insert is the same as that described hereinabove and comprises a body portion and a flange at one end of the body portion. The flange has a greater diameter than the fixed diameter of the body portion so as to prevent the plastic insert from passing through the circular opening of the bracket of either leg. A foot member having a threaded stem may engage the plastic insert making the leg assembly vertically adjustable.

The ability of the leg assembly to comprise multiple members nested within one another enables the height of the leg assembly to be increased without decreasing the stability of the leg assembly. This capability of the leg assemblies to increase in length enables the side rails of the bed frame to be raised further off the ground and still enable the bed frame center support assembly to adequately support a box spring and mattress placed on top of the bed frame center support assembly.

These and other objects and advantages of this invention will be readily apparent from the following description of the drawings.

BRIEF DESCRIPTION OF THE DRAWINGS

FIG. 1A is an enlarged perspective view of the encircled area 1A of FIG. 1;

DETAILED DESCRIPTION OF THE DRAWINGS

Figure 1:
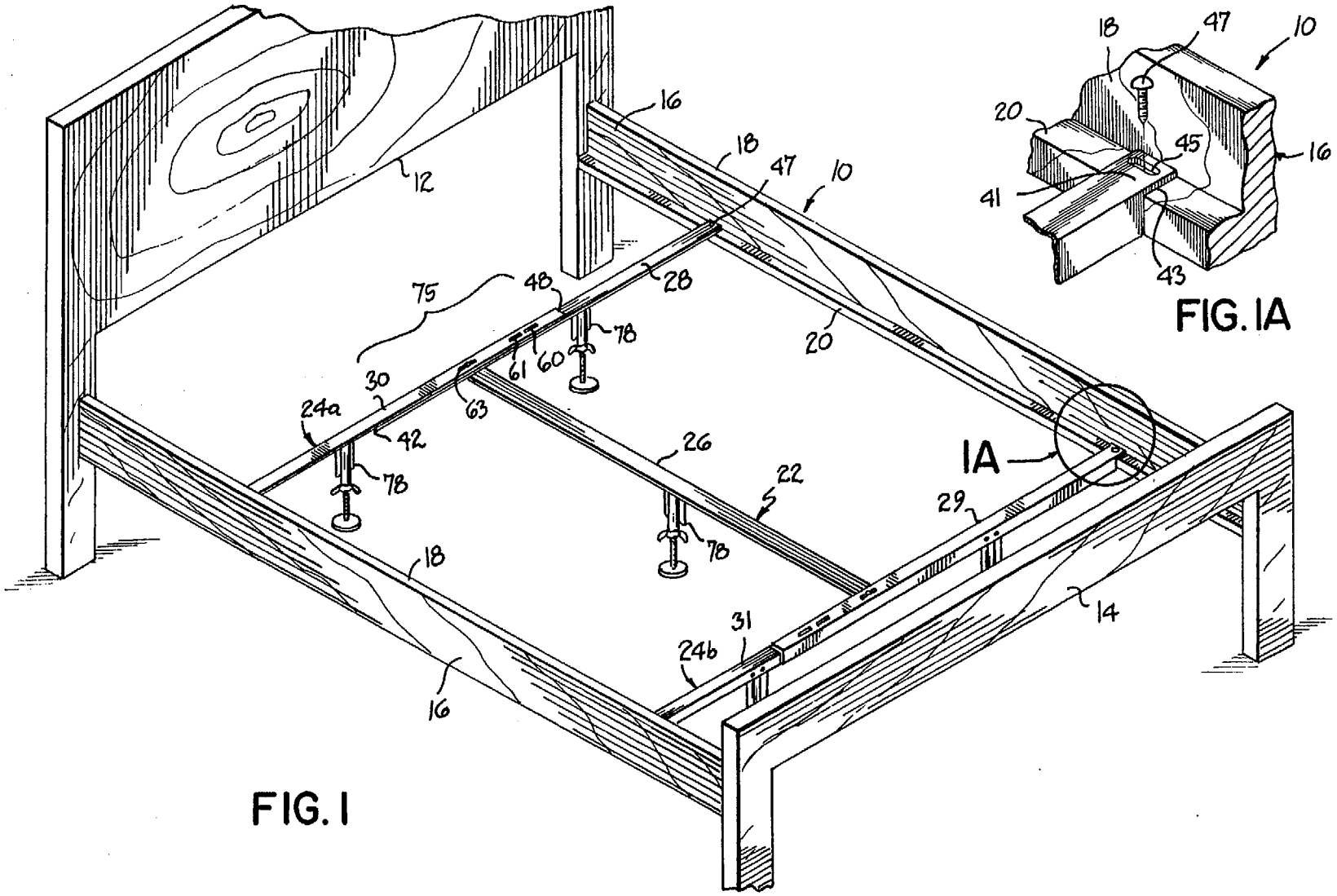
FIG. 1 is a perspective view of the bed frame center support assembly of the present invention secured to a conventional bed frame.

Referring to the drawings and particularly to FIG. 1, there is illustrated a bed frame 10 comprising a headboard 12, a footboard 14 and two opposed side rails 16. The bed frame is typically made of wood but may alternatively be made of other materials such as metal. Each side rail has a vertical portion 18 and a horizontal flange 20, the horizontal flange 20 extending inwardly from the lowermost edge of the vertical portion 18.

A bed frame center support assembly 22 is located generally inside the bed frame between the two opposed side rails 16 and between the headboard 12 and the footboard 14. The center support assembly 22 comprises a pair of spaced parallel cross support members **24*a*, 24*b* and a center support member 26 extending between the cross support members 24*a*, 24*b*. The cross support members 24*a*, 24*b* extend between the two side rails 16 of the bed frame 10 and are secured at their ends to the horizontal flages 20 of the side rails 16. The center support member 26 extends generally perpendicular to the cross support members 24*a*, 24*b* and generally parallel the side rails 16 of the bed frame. The center support member 26 is secured at its ends to the cross support members 24*a*, 24*b***.

Figure 2:
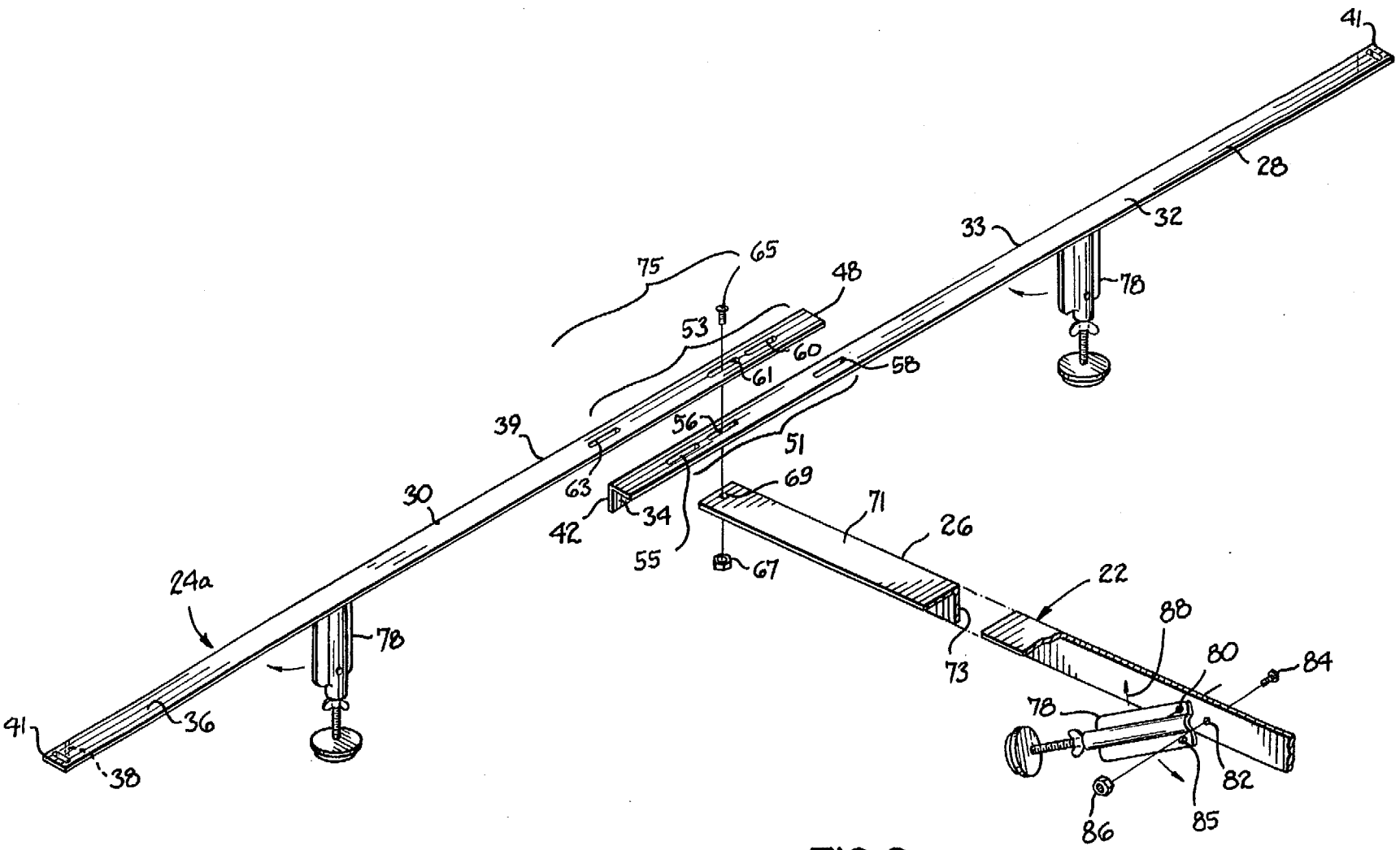
FIG. 2 is an exploded perspective view of a portion of the bed frame center support assembly of FIG. 1.

As best illustrated in FIG. 2, cross support member **24*a* may comprise two L-angle cross bars, a first L-angle cross bar 28 and a second L-angle cross bar 30. The first L-angle cross bar 28 has a horizontal web 32 and a vertical web 34, the vertical web 34 extending downwardly from the outside edge 33 of the horizontal web 32. Likewise, the second L-angle cross bar 30 has a horizontal web 36 and a vertical web 38, the vertical web 38 extending downwardly from the outside edge 39 of the horizontal web 36. Each of the cross support members therefore has an "L" shaped cross-sectional configuration. Although not specifically illustrated in FIG. 2, cross support member 24*b* comprises two overlapping nested L angle cross bars 29, 31 (see FIG. 1**).

As best seen in FIG. 1A, a notch 43 is cut out of the vertical web at the outside end 41 of each L angle cross bar in order to secure one of the cross support members **24*a*, 24*b* to the side rails 16 of the bed frame 10. Notch 43 enables the horizontal web of the L angle cross bar to sit flat on top of the horizontal flange 20 of the side rail 16 as illustrated in FIG. 1A. A hole or slot 45 is cut in the horizontal web enabling a fastener 47 to pass through the horizontal web and the horizontal flange 20 of the side rail 16 to secure the cross support member 24*a*, 24*b* to the side rail 16**.

As illustrated in FIG. 2, the first and second L angle cross bars 28, 30 have an overlapped portion 75. In the overlapped portion 75, a central portion 51 of the first L-angle cross bar 28 overlaps with a central portion 53 of the second L-angle cross bar 30 with the central portions 51, 53 nested inside one another. The drawings illustrate the first L-angle cross bar 28 being nested inside the second L-angle cross bar 30 but the reverse may also occur with the second L-angle cross bar 30 being nested inside the first L-angle cross bar 28.

As illustrated in FIG. 2, two adjacent holes or slots 55, 56 are formed in the horizontal web 32 at the end 42 of the first L-angle cross bar opposite end 41. A third slot 58 is also formed through the horizontal web 32 of the first L-angle cross bar 28 closer to the outer end 41. Likewise, two slots 60, 61 are formed through the horizontal web 36 of the second L-angle cross bar 30 in the end 48 of the cross bar 30 opposite the outer end 41. A third slot 63 is formed outwardly from slots 60 and 61 through the horizontal web 36 of the second L-angle cross bar 30. The purpose of these slots is to enable a fastener 65 to pass through two aligned slots and be secured on the bottom with a nut 67 in order to secure the first and second L-angle cross bars 28, 30 together in a nested relationship. The fastener 65 also passes through a hole or slot 69 formed in an end of the center support member 26.

The purpose of the slots formed in the horizontal webs of the L-angle cross bars is to enable the length of the cross support members 24*a*, 24*b* to be increased or decreased depending upon the width of the bed, i.e. the distance between the opposed side rails of the bed frame. As illustrated in FIG. 2, slots 61 and 56 may be aligned on top of one another in order to provide a medium length of the cross support member 24*a*. If a shorter cross support member 24*a* is desired, slot 63 of second L-angle cross bar 30 and slot 58 of first L-angle cross bar 28 are aligned and fastener 65 passed therethrough and secured. With a shorter cross support member, a larger portion of the first and second L-angle cross bars 28, 30 overlap with one another and are nested inside one another. If a longer cross support member is desired as for example with a king sized bed, slot 60 of second L-angle cross bar 30 is aligned with slot 55 of first L-angle cross bar 28 and fastener 65 passed therethrough and secured. As will be obvious, both of the cross support members are identically configured with two L-angle cross bars and holes in approximately the same locations so that the lengths of the two cross support members may be identical.

As best illustrated in FIG. 2, the center support member 26 comprises a horizontal web 71 and a vertical web 73. The vertical web 73 depends downwardly from one of the edges of the horizontal web 71 creating an L shaped cross sectional configuration. The center support member 26 is illustrated as being one piece, but may alternatively be multiple pieces. At each end of the center support member 26 is a hole 69 through the horizontal web 71. The horizontal web 71 of the center support member at each end is placed underneath the lower L-angle cross bar in the overlapped portion 75 of the cross support members so the fastener 65 may pass through holes 69.

As illustrated in FIGS. 1 and 2, each of the first and second L-angle cross bars 28, 30 and the center support member 26 has a leg assembly 78 dependent therefrom. The leg assembly 78 is pivotally secured to a vertical web of one of the support members, either the center support member 26 or one of the cross support members 24*a*, 24*b*. A fastener 80, such as a rivet, secures the leg assembly 78 to the vertical web as illustrated in FIG. 2. A hole 82 is formed through the vertical web of the support member adjacent fastener 80. In order to secure the leg assembly 78 in a down locked position, a second fastener 84, such as a screw, may be passed through the hole 82, through a hole 85 in the upper portion of the leg assembly and secured with a nut 86. By removing fastener 84 and nut 86, the leg assembly 78 can be pivoted upwardly in the direction of arrow 88 (see FIG. 2) so that the leg assembly 78 is between the vertical and horizontal webs of the support member. Once the screw 84 is inserted and secured, the leg assembly is locked in a down-locked position.

The leg assembly 78 may take on alternative configurations using a relatively few number of parts. One embodiment of the leg assembly 78 illustrated in FIG. 3 comprises a first leg 90, a plastic insert 100, a wing nut 114 and a foot member 108. The first leg 90 has two coplanar flanges 92*a*, 92*b* separated by a longitudinally extending groove 94. The lower portions of the flanges 92*a*, 92*b* are wrapped around each other so as to form a bracket 96. The bracket 96 is integrally formed in the end of the first leg 90 remote from the first leg's pivotal connection to the vertical web of either a cross support member 24*a*, 24*b* or the center support member 26. The bracket 96 has a circular opening 98 therethrough of a fixed diameter. The opening 98 is circular in cross section.

Figure 3:
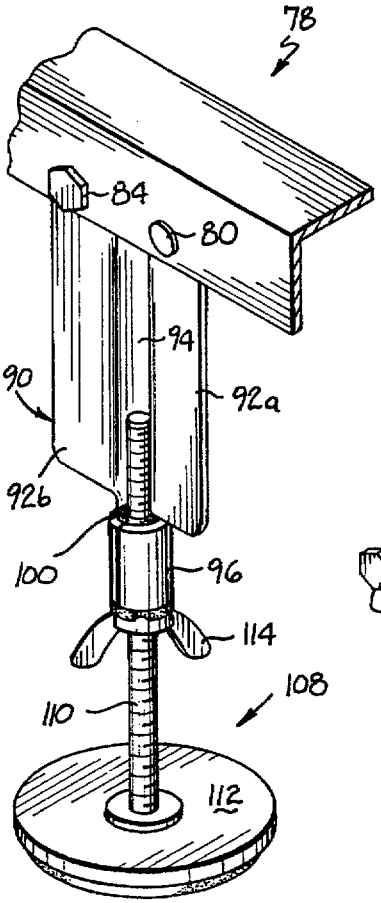
FIG. 3 is a perspective view of one embodiment of the leg assembly secured to one of the support members of the bed frame center support assembly, the leg assembly comprising a first leg secured to a vertical web of the support member, a plastic insert and a foot member.
Figure 4:
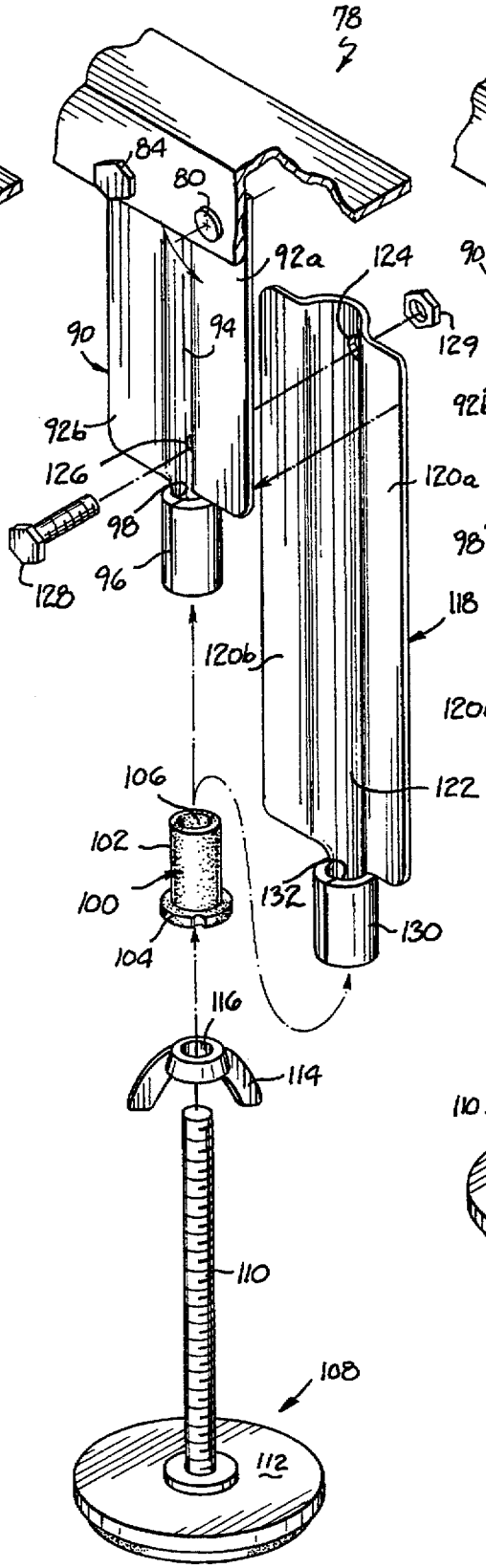
FIG. 4 is an exploded perspective view of an alternative embodiment of the leg assembly comprising a first leg secured to a vertical web of one of the support members, a second leg, a plastic insert, and an adjustable foot member.

As best illustrated in FIGS. 3 and 4, the plastic insert 100 is adapted to fit inside the circular opening 98 of the bracket 96. As seen in FIG. 4, the plastic insert 100 has a cylindrical body portion 102 and a flange 104 at one end of the body portion. The flange 104 has an outer diameter greater than the outer diameter of the body portion 102 so as to prevent the plastic insert 100 from passing through the circular opening 98 of the bracket 96. The plastic insert 100 has a threaded thoroughbore 106 extending through the body portion 102 and the flange 104.

The leg assembly 78 further comprises a foot member 108 having a threaded stem 110 and a circular bottom 112. The threaded stem 110 extends upwardly from the circular bottom 112 of the foot member 108 and is adapted to engage the threaded thoroughbore 106 of the plastic insert 100 so as to provide an adjustable leg assembly in which the distance from the bottom of the foot member to the support member of the center support assembly can be adjusted by threading the stem 110 through the threaded thoroughbore 106 of the plastic insert 100. A wing nut 114 having a threaded interior hole 116 therethrough is adapted to engage the threaded stem 110 below the plastic insert 100 so that by rotating the wing nut 114, the height of the foot member 108 will be fixed until the wing nut is loosened.

Figure 5:
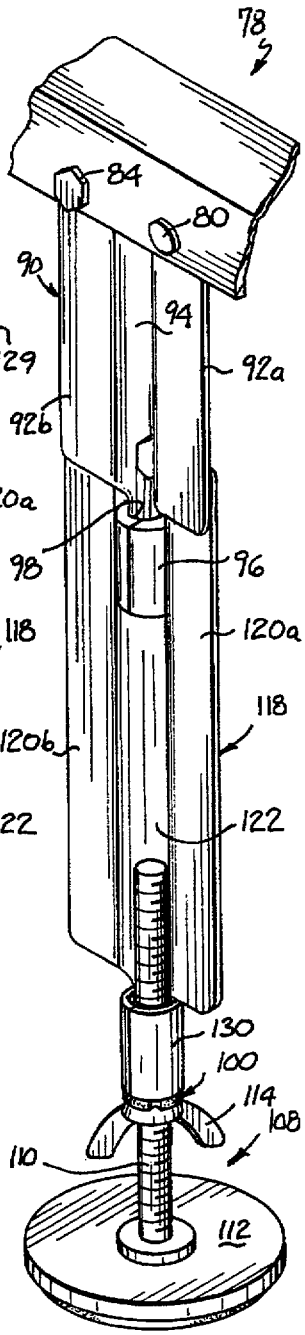
FIG. 5 is a perspective view of the leg assembly of FIG. 4 when assembled.

As illustrated in FIGS. 4 and 5, the leg assembly 78 may further comprise a second leg 118 similarly cross-sectionally configured to that of the first leg 90, i.e. having two outer flanges 120*a*, 120*b* separated by a longitudinally extending groove 122. The longitudinal dimension of the second leg 118 may or may not be longer than that of the first leg 90. A hole 124 is located at the top of the groove 122 in the second leg 118 as illustrated in FIG. 4. Similarly, a hole 126 is located in the groove 94 of the first leg 90 so that the length of the leg assembly may be increased by aligning the holes 124, 126 and passing a fastener 128 therethrough. The threaded fastener 128 may engage a nut 129 in order to secure the top of the second leg 118 to the bottom of the first leg 90. The bracket 96 of the first leg 90 nests inside the groove 122 of the second leg, as best illustrated in FIG. 5.

Like the first leg, the second leg 118 has a bracket 130 integrally formed from the flanges 120*a*, 120*b* of the second leg 118. The flanges 120*a*, 120*b* are wrapped around toward each other so as to define a circular opening 132. The circular opening 132 of the bracket 130 of the second leg 118 is approximately the same diameter as the diameter of the circular opening 98 of the bracket 96 formed in the first leg 90. As illustrated in FIG. 5, the plastic insert 100 may be inserted into the circular opening 132 of the bracket 130 and the threaded stem 110 of the foot member 108 screwed into the threads of the plastic insert 100. A wing nut 110 may be located between the plastic insert 100 and the bottom 112 of the foot member 108. The wing nut 114 may be tightened in order to fix the length of the leg assembly.

Thus, the leg assembly of the present invention may be pivotally secured to a vertical web of one of the members of the center support assembly and may be locked in a downward locked position. In addition, the leg assembly 78 may comprise solely a first leg 90 as illustrated in FIG. 3 adapted to engage a threaded foot member or the leg assembly 78 may comprise a first leg 90 and a second leg 118, the second leg 118 being adapted to receive a threaded foot member 108. In this fashion, the length of the leg assembly can be increased more than heretofore known leg assemblies thus enabling the side rails to be higher off the ground or supporting surface than heretofore possible.

While I have described several preferred embodiments of the bed frame center support assembly, persons skilled in the art will appreciate changes and modifications which may be made to the bed frame center support assembly without departing from the spirit of the invention of this application. Therefore, I intend to be limited only by the scope of the following appended claims.

I claim:

1. A bed frame center support assembly comprising:

a pair of spaced, parallel cross support members extending between two opposed side rails of a bed frame, a center support member extending between said cross support members and being generally perpendicular to the cross support members, said center support member having an "L" shaped cross sectional configuration, at least one leg assembly pivotally secured to one of said support members, said leg assembly comprising a first leg pivotally secured to a vertical web of said one of said support members, said first leg having a hole therethrough adapted to receive a fastener for securing the first leg in a down locked position, said first leg having two coplanar flanges separated by a longitudinally extending groove and a bracket integrally formed in the end of the first leg remote from its pivotal connection to the vertical web, said bracket having an opening therethrough.

2. The bed frame center support assembly of claim 1 further comprising a plastic insert adapted to fit inside said opening, said plastic insert having a body portion and a flange at one end of the body portion, said plastic insert having a threaded thoroughbore extending through said body portion and said flange, and a foot member having a threaded stem, said threaded stem being adapted to engage the threaded thoroughbore of the plastic insert to provide an adjustable leg in which the distance from the foot member to the cross rails of the bed frame can be adjusted by threading the stem through the threaded thoroughbore.

3. The bed frame center support assembly of claim 1 further comprising a second leg, said second leg being secured to the first leg of said leg assembly, said second leg having two coplanar flanges, a longitudinally extending groove between the flanges and a bracket integrally formed from the end of the second leg remote from its connection to the first leg, said bracket of said second leg having an opening therethrough, said second leg being nested with said first leg such that said bracket of said first leg resides in said groove of said second leg and said legs are connected by a fastener passing through the nested grooves of the legs.

4. The bed frame center support assembly of claim 3 further comprising:

a plastic insert comprising a body member adapted to fit in the opening in the bracket of the second leg, said body member having a flange larger than the opening at one end of the body member and a threaded thoroughbore extending through said body member, and a foot member having a threaded stem extending outwardly therefrom and being adapted to engage the threaded thoroughbore of the plastic insert to provide an adjustable leg in which the distance from the foot member to the cross rails of the bed frame can be adjusted by threading the stem through the threaded thoroughbore.

5. A bed frame center support assembly comprising:

a pair of spaced, parallel cross support members, each cross support member extending between two opposed side rails of a bed frame and comprising two nested "L" angle cross bars, each having horizontal and vertical webs with notches cut out of the vertical webs at opposed ends of the cross support members whereby the horizontal webs are adapted to lie flat on horizontal flanges of the side rails of the bed frame, a center support member extending between said cross support members and being generally perpendicular to the cross support members, said center support member having an "L" shaped cross sectional configuration, a plurality of leg assemblies, at least one leg assembly being secured to each of said cross support members and at least one leg assembly being secured to said center support member, each leg assembly comprising a first leg pivotally secured to a vertical web, a fastener for securing the first leg in a down position, said first leg having two coplanar flanges, a groove extending longitudinally between the flanges and a bracket integrally formed in the end of the first leg remote from its pivotal connection to the vertical web, said bracket having a circular opening therethrough.

6. The bed frame center support assembly of claim 5 further comprising:

a plastic insert comprising a body member adapted to fit in the opening, said body member having a flange larger than the opening at one end of the body member and a threaded thoroughbore extending through said body member, and a foot member having a threaded stem extending outwardly therefrom and being adapted to engage the threaded thoroughbore of the plastic insert to provide an adjustable leg in which the distance from the foot member to the cross rails of the bed frame can be adjusted by threading the stem through the threaded thoroughbore.

7. The bed frame center support assembly of claim 5 further comprising a second leg, said second leg being secured to the first leg of each leg assembly, said second leg having two coplanar flanges, a longitudinally extending groove between the flanges and a bracket integrally formed in the end of the second leg remote from its connection to the first leg, said bracket having a circular opening therethrough, said second leg being nested with said first leg such that said bracket of said first leg resides in said groove of said second leg and said legs are connected by a fastener passing through the nested grooves of the legs.

8. The bed frame center support assembly of claim 7 further comprising:

a plastic insert comprising a body member adapted to fit in the opening in the bracket of the second leg, said body member having a flange larger than the opening at one end of the body member and a threaded thoroughbore extending through said body member, and a foot having a threaded stem extending outwardly therefrom and being adapted to engage the threaded thoroughbore of the plastic insert to provide an adjustable leg in which the distance from the foot to the cross rails of the bed frame can be adjusted by threading the stem through the threaded thoroughbore.

9. A bed frame center support assembly comprising:

a pair of spaced, parallel cross support members extending between two opposed side rails of a bed frame, a center support member extending between said cross support members and being generally perpendicular to the cross support members, at least one leg assembly pivotally secured to one of said support members, each leg assembly comprising a first leg pivotally secured to a vertical web of said one of said support members, said first leg having a hole therethrough adapted to receive a fastener for securing the first leg in a down locked position, said first leg having two coplanar flanges separated by a longitudinally extending groove and a bracket integrally formed in the end of the first leg remote from its pivotal connection to the vertical web, said bracket having an opening therethrough, said leg assembly further comprising a second leg, said second leg being secured to the first leg of said leg assembly, said second leg having two coplanar flanges, a longitudinally extending groove between the flanges and a bracket integrally formed from the end of the second leg remote from its connection to the first leg, said bracket of said second leg having an opening therethrough, said second leg being nested with said first leg such that said bracket of said first leg resides in said groove of said second leg and said legs are connected by a fastener passing through the nested grooves of the legs.

10. The bed frame center support assembly of claim 9 further comprising:

a plastic insert comprising a body member adapted to fit in the opening in the bracket of the second leg, said body member having a flange larger than the opening at one end of the body member and a threaded thoroughbore extending through said body member, and a foot member having a threaded stem extending outwardly therefrom and being adapted to engage the threaded thoroughbore of the plastic insert to provide an adjustable leg in which the distance from the foot member to the cross rails of the bed frame can be adjusted by threading the stem through the threaded thoroughbore.

11. A leg assembly for use with a bed frame center support assembly, said leg assembly comprising:

a first leg adapted to be pivotally secured to a support member of a bed frame center support assembly, said first leg having a hole therethrough adapted to receive a fastener for securing said first leg in a down locked position, a second leg connected to said first leg, said second leg having two coplanar flanges, a longitudinally extending groove between the flanges and a bracket integrally formed from the end of the second leg remote from its connection to the first leg, said bracket having an opening therethrough, and an adjustable foot member extending through said opening.

12. The leg assembly of claim 11 further comprising a plastic insert comprising a body member adapted to fit in the opening through said bracket, said body member having a flange larger than the opening at one end of the body member and a threaded thoroughbore extending through said body member, and said adjustable foot member having a threaded stem extending outwardly therefrom and being adapted to engage the threaded thoroughbore of the plastic insert to provide an adjustable leg in which the distance from the foot member to the bed frame center support assembly can be adjusted by threading the stem through the threaded thoroughbore.

13. The leg assembly of claim 11 wherein said first leg has two coplanar flanges separated by a longitudinally extending groove and a bracket integrally formed in the end of the first leg remote from its pivotal connection to the vertical web.

14. The leg assembly of claim 13 wherein said second leg is nested with said first leg such that said bracket of said first leg resides in said groove of said second leg and said legs are connected by a fastener passing through the nested grooves of the legs.

15. A bed frame center support assembly comprising:

a pair of spaced, parallel cross support members extending between two opposed side rails of a bed frame, a center support member extending between said cross support members and being generally perpendicular to the cross support members, at least one leg assembly pivotally secured to one of said support members, each leg assembly comprising a first leg having two coplanar flanges separated by a longitudinally extending groove and a bracket integrally formed in the end of the first leg remote from its pivotal connection to the vertical web, said leg assembly further comprising a second leg, said second leg being nestably secured to the first leg of said leg assembly, said second leg having two coplanar flanges, a longitudinally extending groove between the flanges and a bracket integrally formed from the end of the second leg remote from its connection to the first leg, said bracket of said second leg having an opening therethrough.

16. The bed frame center support assembly of claim 15 wherein said second leg is nested with said first leg such that said bracket of said first leg resides in said groove of said second leg and said legs are connected by a fastener passing through the nested grooves of the legs.

17. The bed frame center support assembly of claim 15 further comprising a plastic insert adapted to fit inside said opening, said plastic insert having a cylindrical body portion and a flange at one end of the body portion, said plastic insert having a threaded thoroughbore extending through said body portion and said flange, and a foot member having a threaded stem, said threaded stem being adapted to engage the threaded thoroughbore of the plastic insert to provide an adjustable leg in which the distance from the foot member to the cross rails of the bed frame can be adjusted by threading the stem through the threaded thoroughbore.

18. The bed frame center support assembly of claim 17 wherein said foot member has a circular bottom member.

19. A leg assembly for use with a bed frame center support assembly, said leg assembly comprising a first leg pivotally secured to a vertical web of said one of said support members, said first leg having a hole therethrough adapted to receive a fastener for securing the first leg in a down locked position, said first leg having two coplanar flanges separated by a longitudinally extending groove and a bracket integrally formed in the end of the first leg remote from its pivotal connection to the vertical web, said bracket having an opening therethrough, said leg assembly further comprising a second leg, said second leg being secured to the first leg of said leg assembly, said second leg having two coplanar flanges, a longitudinally extending groove between the flanges and a bracket integrally formed from the end of the second leg remote from its connection to the first leg, said bracket of said second leg having a circular opening therethrough, said second leg being nested with said first leg such that said bracket of said first leg resides in said groove of said second leg and said legs are connected by a fastener passing through the nested grooves of the legs.

20. The leg assembly of claim 19 further comprising:

a plastic insert comprising a body member adapted to fit in the circular opening in the bracket of the second leg, said body member having a flange larger than the circular opening at one end of the body member and a threaded thoroughbore extending through said body member, and a foot member having a threaded stem extending outwardly therefrom and being adapted to engage the threaded thoroughbore of the plastic insert to provide an adjustable leg in which the distance from the foot member to the bed frame center support assembly can be adjusted by threading the stem through the threaded thoroughbore.

* * * * *